United States Patent [19]

Rölli et al.

[11] Patent Number: 4,947,014

[45] Date of Patent: Aug. 7, 1990

[54] METHOD AND APPARATUS FOR PRODUCING CAN BODIES OF A NON-CIRCULAR CROSS-SECTION

[75] Inventors: Hans Rölli, St-Blaise; Jakob Müller, Enges, both of Switzerland

[73] Assignee: Fael S.A., Saint-Blaise, Switzerland

[21] Appl. No.: 259,772

[22] Filed: Oct. 19, 1988

[30] Foreign Application Priority Data

Oct. 22, 1987 [CH] Switzerland ..... 4138/87

[51] Int. Cl.[5] ..... B23K 11/00

[52] U.S. Cl. ..... 219/64; 413/73

[58] Field of Search ..... 219/64; 413/69, 70, 413/72, 73, 74

[56] References Cited

U.S. PATENT DOCUMENTS

| | | | |
|---|---|---|---|
| Re. 26,658 | 9/1969 | McCoy | 219/64 |
| 828,723 | 8/1906 | Dugan | 413/73 |
| 4,693,658 | 9/1987 | Glerum et al. | 219/64 |

*Primary Examiner*—Clifford C. Shaw

*Attorney, Agent, or Firm*—Laurence R. Brown

[57] ABSTRACT

In order to produce can bodies having a noncircular cross-section, preferably a rectangular cross-section with rounded corners, flat planar blanks are initially deformed in a deforming station by a plurality of similar bending tools, each for producing one respective bend, whereby a respective different bend is made at the same time at the various blanks of the stepwise timed advancing blanks. The bending tool includes a shaping member held stationary at the inside and having a curved outer surface end, furthermore, a roller supported in a supporting body and which is subjected to the action of a spring pressing against the supporting body in order to bend the blank located between the shaping member and pressing roller upwardly during movement by a lifting rod pivotably mounted at the supporting body. This proceeds simultaneously in all bending tools provided for one respective bend by a movable part of the deforming apparatus operating as a press. The blank is moved stepwise from one to the next bending station, such that after a plurality of operating steps a can body having a rectangular cross-section and rounded corners is formed of which the free edges are interconnected in a next following welding station by electrical resistance welding.

19 Claims, 4 Drawing Sheets

METHOD AND APPARATUS FOR PRODUCING CAN BODIES OF A NON-CIRCULAR CROSS-SECTION

BACKGROUND OF THE INVENTION

1. Field of the Invention

The present invention relates to a method of producing can bodies of a non-circular cross-section from planar of which the oppositely located edges of the blank will be interconnected in a longitudinal seam. The invention relates further to an apparatus for practicing said method.

2. Description of the Prior Art

Resistance roll-welding machines for the production of can bodies from planar blanks which include in addition to the welding device a bending apparatus for deforming the blanks and allow a production of a high number of can bodies per minute are generally known; these known machines are, however, suitable only for the production of cylindrical can bodies. Cans of non-circular cross-section, specifically such of a rectangular cross-section for receipt of foodstuff which are available on the market in high numbers have until now been produced predominantly by means of a soldering procedure during which the can bodies which have been shaped from planar blankets are conveyed through a soldering bath. The soldering material consists, however, to the largest part of lead and should therefore not come into contact with foodstuff, such that due to the presently increased attention given to the environment to be less burdened by noxious material there is the desire to substitute a different production method for the soldering method practiced for the production of cans. Cans are for instance generally known which have been produced by a soldering method and which have a rectangular cross-section and which taper towards their top and which due to this shape have the consumer recognizing that a specific content, such as a specifically prepared beef, is contained therein. This can having the function of a trade-mark shall quite obviously be maintained but at the same token it is desired to do away with the soldering method which until now has not been possible. Such cans are in many instances provided further with a tear-open strip extending therearound and defined by pre-scored scoring lines and including a tear-open flap located at one and such to allow an easy opening of the can without having to use a specific tool. This tear-open flap projects from one edge of the planar blank from which the can is produced, and due to this tear-open flap the production of such a can is made difficult still more if it cannot be produced by aid of the known soldering method.

In order to produce cans of a rectangular cross-section a compromise has already been made in that initially cylindrical cans were produced by the known resistance seam-welding method and thereafter deformed to a non-circular cross-section. If it is desired, however, to produce in addition to such rectangular shape a can which tapers towards one end by such method it is not possible to do such without a severe straining of the sheet metal due to the stretching or expanding of the sheet metal at the end having the larger cross-section. It is possible that the material ruptures and during the expanding of such a can body considerable stresses are generated therein which can lead to a bursting of the pre-scored lines. Such a production method is hardly advantageous and apart from such method there is quite a large necessity of machinery and correspondingly high investment costs therefore.

The blanks used for producing cylindrical can bodies are exactly rectangular whereas the blanks needed for a tapering can body must have a development of a truncated cone in which two opposite edges extend curvilinearly. The shape of the blank for a can body having a rectangular cross-section and rounded corners and in which additionally the size or magnitude of the cross-section changes continuously along the length of the can, i.e. in which a taper is present, is similar to above described development of the jacket of a truncated cone, but including rectilinearly extending partial sections at both outer edges. Such a blank leads after its deforming to a can body without any inner tensions and it is possible to conclude from the difference between the shapes of the blanks without any further ado that a can body which initially has been produced cylindrially can thereafter be forced only by a large expenditure of force into a rectangular and additionally tapering shape.

SUMMARY OF THE INVENTION

A general object of the present invention is to provide a production of can bodies from planar blanks and which do not have a circular cross-section and include preferably a rectangular cross-section and rounded corners, which, however, can feature a triangular cross-section or shaped with more than four corners.

A further object is to provide a production of such can bodies which have a size which changes continuously along the length of the body of the can, i.e. can bodies having a taper which specifically facilitates the emptying thereof.

Yet a further object is to provide a production of such can bodies which additionally comprise a tear-open strip whereby preferably the electrical resistance welding by means of a resistance roll-welding machine is applied for the interconnecting of the edges of the blank, whereby, however, bonding (glueing) or laser-welding procedures are also applicable.

Still a further object of the invention is to provide a method of producing such can bodies comprising the steps of a stepwise deforming of blanks having an outer contour corresponding to the development of the can bodies having a non-circular cross-section by means of bending tools in a deforming station for respectively producing a plurality of can body side walls such that the edges to be interconnected are positioned opposite of each other and of advancing the can bodies by means of at least one conveying apparatus to a working station located after the deforming station for interconnecting the edges by producing a longitudinal seam.

A further object is to provide an apparatus for producing can bodies of a non-circular cross-section comprising a deforming station including a plurality of bending tools operative for a stepwise deforming of blanks conveyed in succession through said deforming station for the producing of can bodies having a non-circular cross-section; comprising further a conveying apparatus operative for conveying the can bodies through said deforming station and along a conveying route, and a working station for producing a longitudinal seam and adjoining the end of the conveying route and including at the zone thereof a calibration apparatus for can bodies of a noncircular cross-section.

The advantages of the new method and apparatus are that specifically shaped can bodies and such including a tear-open strip can be produced from planar blanks of a magazine can be produced by machine and in high numbers per unit of time.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
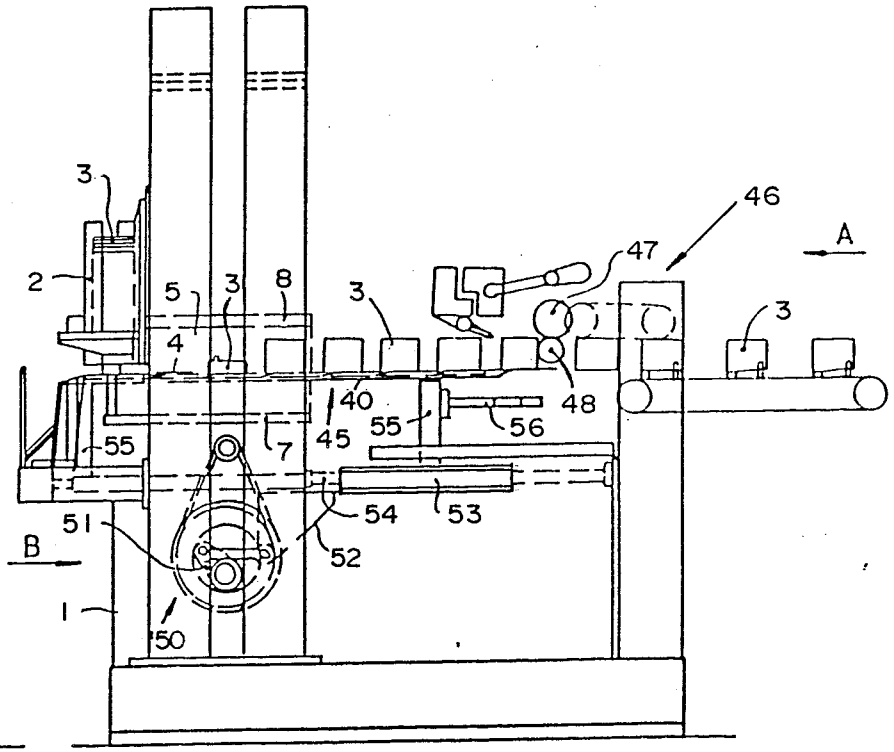
FIG. 1 is a front view of the apparatus for deforming the blanks and producing of the can bodies by welding.
Figure 2:
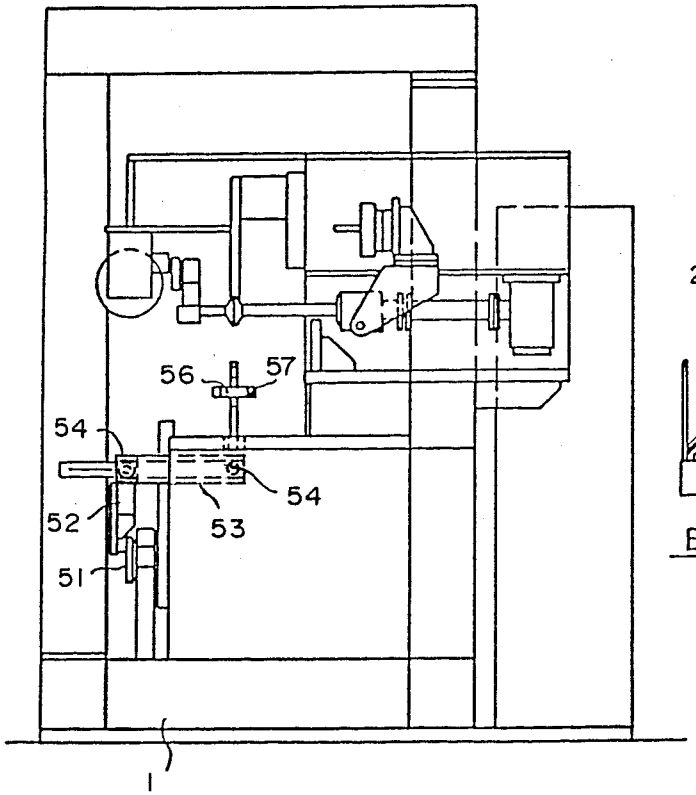
FIG. 2 is a side-view of the apparatus of FIG. 1 in the direction according to the arrow A of FIG. 1.
Figure 3:
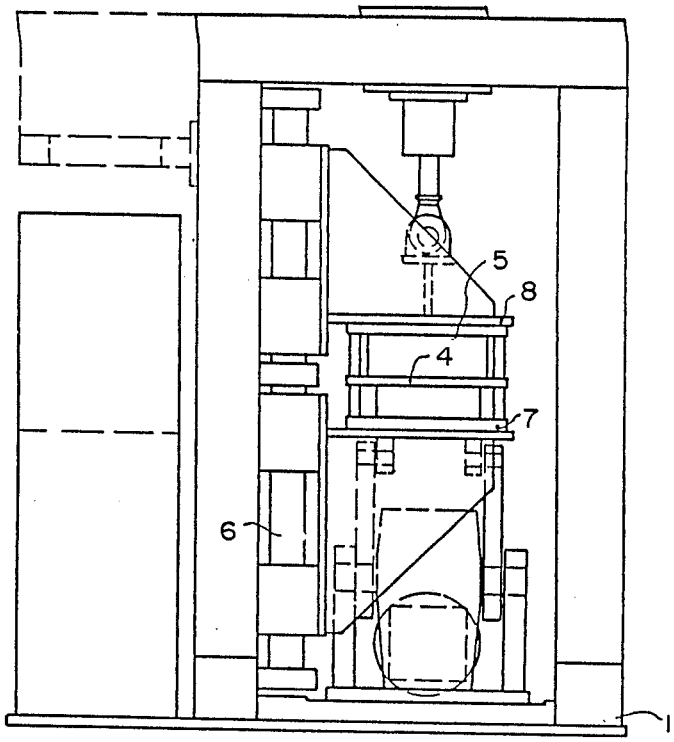
FIG. 3 is a side-view of the most important parts of the apparatus of FIG. 1 in the direction of the arrow B of FIG. 1.
Figure 5:
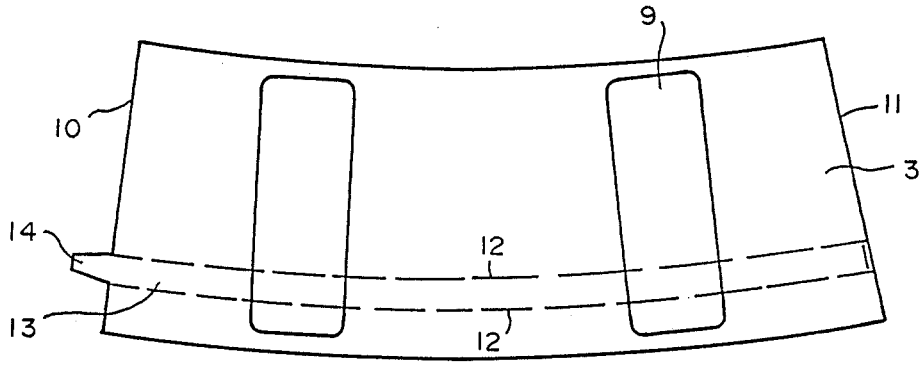
FIG. 5 illustrates on an enlarged scale the blank for the production of can bodies having a rectangular cross-section.

The apparatus of which various views are illustrated in FIGS. 1 to 3 is an apparatus for the production of can bodies from planar blanks by application of an electrical resistance welding by aid of welding electrode rollers, which apparatus is also termed a resistance rollwelding machine and includes at the machine frame 1 in FIG. 1 at the left side a magazine 2 for receipt of a stack of planar blanks 3. The blanks 3 of which one is illustrated in FIG. 5 on an enlarged scale are individually removed from the stack in the magazine 2 and arrive at the intermediate table 4 of the deforming station 5 which operates such as a press. This station 5 is also designed on the basis of a press and includes a lower press table 7 which in accordance with FIG. 3 is guided along guide columns and is movable upwards and downwards. An upper pressing table 8 is located oppositely thereof. A blank 3 drawn from the stack in the magazine 2 is firstly provided in the pressing or deforming station by means of a not illustrated pressing or stamping tool with flat corrugations 9 illustrated in FIG. 5 and located in the areas of the blank which will form later the larger side walls of the can body of a rectangular cross-section. These flat corrugations or impressments 9 lead to a stiffening of the side walls of the can body. The principle of the production of such corrugations is generally known and, therefore, not illustrated.

The blank 3 which is drawn in FIG. 5 on an enlarged scale includes at its two opposite ends two edges 10 and 11 which are to be welded together. The blank includes, furthermore, a tear-open strip 13 defined by prescored lines 12 which tear-open strip 13 ends in a tearopen flap 14 projecting over the edge 10 and extending over the entire length of the blank.

Figure 4:
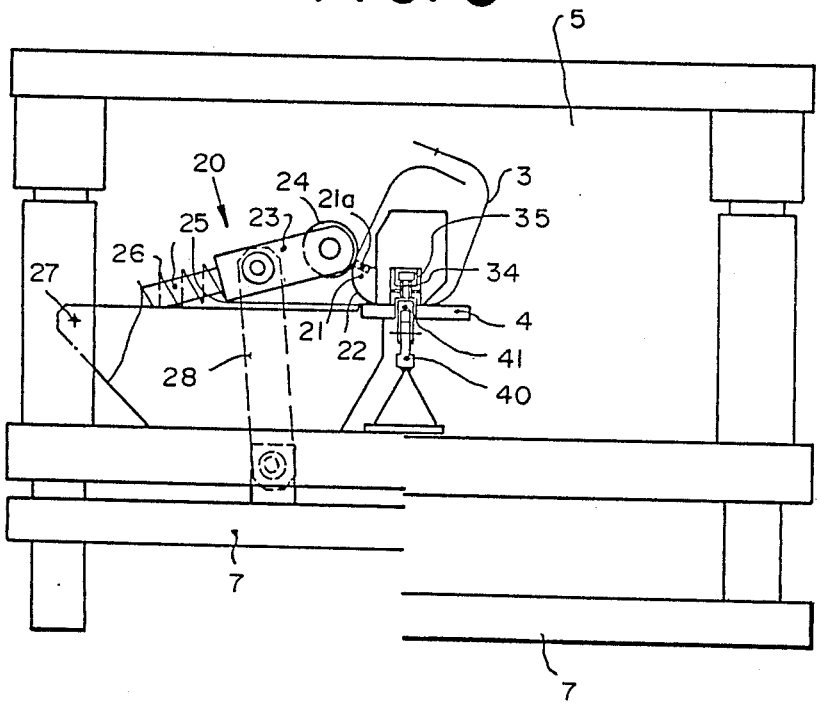
FIG. 4 illustrates on an enlarged scale a section of a part of the blank deforming station included in a press.
Figure 6A:
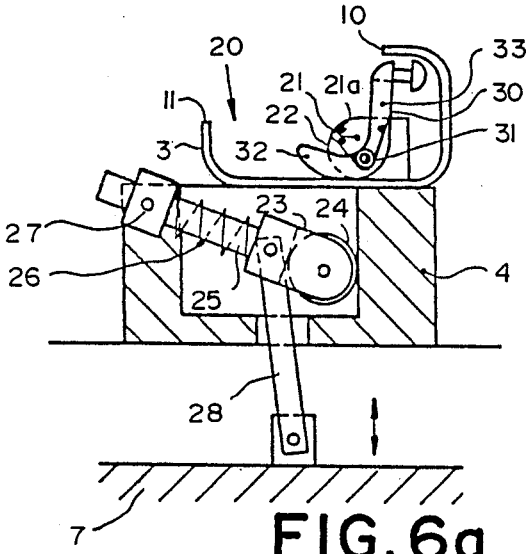
FIGS. 6*a*, *b* and *c* illustrate the principle of the stepwise deforming of the blanks on a schematic view of the apparatus, in FIGS. 6*a* and *b* in a side view and in FIG. 6*c* in a top view.

Following the producing of the corrugations 9 in the blank 3, the four rounded corners of the can body of rectangular cross-section are made in the the deforming station. A bending tool 20 used for this task is illustrated in FIG. 4, which Figure discloses the arrangement inside the deforming station 5. The principle of the bending procedure is shown in FIGS. 6*a*, *b* and *c*. First of all, the areas of the blank which adjoin the two edges 10 and 11 of the blank which are to be welded together are bent in a measure corresponding respectively to half a side-wall of the can body upwards from the blank by 90°. The welding seam will be located later at the center of this sidewall of the can body having a rectangular cross-section.

Figure 6B:
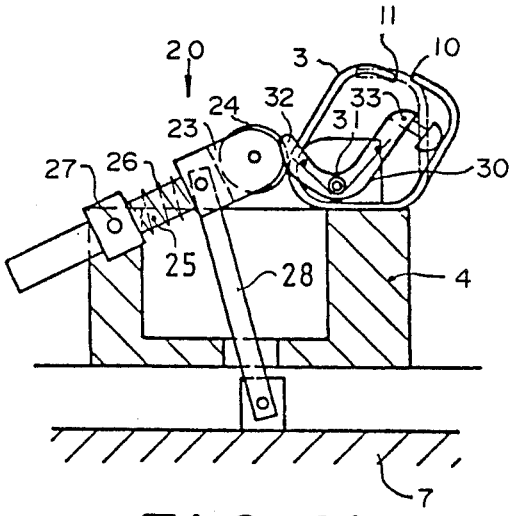
Figure 6C:
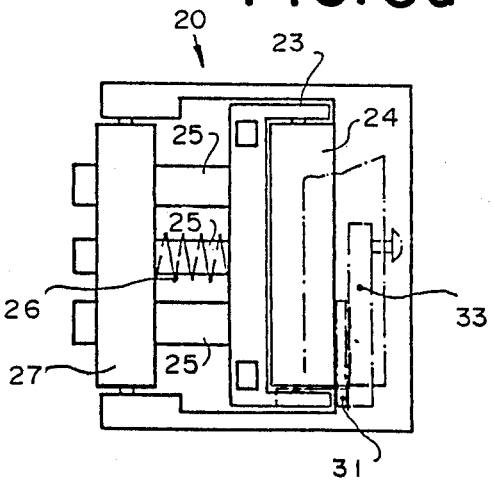

According to the illustration of FIG. 6*b* these bending steps have already been terminated, they follow, however, the same principles according to the illustration of FIG. 6*a*. A separate bending tool 20 is provided for every bending step and the blank is conveyed further from one to the next bending tool in a timed stepwise fashion. According to the illustration of FIG. 6*c*, three bends formed on the basis on this principle have already been made, i.e. the two areas of the blank adjoining the edges 10 and 11 to be welded together are bent upwards, and, furthermore, one of the broader side surfaces of the can body is bent upwards. Each bending tool 20 includes a shaping member 21 as a counter tool which is held stationary inside of the can body to be produced, which shaping member 21 possesses a curvilinear outer surface 22 having a radius of curvature which in correspondence with the elasticity and thickness of the sheet metal is smaller than the radius of curvature of the rounded corner of the can body to be produced. A shaping member section 21*a* adjoins the curvilinear surface 22. The shaping member 21 is held stationary above the blank 3. The bending tool 20 includes further a pressing tool 23, 24 operative to press against the blank from the outer side. It includes a supporting body 23 for a roller 24 supported in this supporting body, further a guide 25 for the supporting body 23 on which the supporting body is guided for a longitudinal shifting movement, and a pressure spring 26 by means of which the roller 24 is pressed onto the blank if the guide 25 which is pivotable around an axis 27 extending parallell to the bending edge formed by the curvilinear surface 22 is moved according to FIG. 6*a* upwards and along the curvilinear surface 22 of the shaping member 21 by means of a pivotably supported lifting rod 28 such to bend the blank 3 around. The condition arrived at thereby is illustrated in FIG. 6*b*. In order to allow for the elasticity of the material and the large radius of the bend this bending must be made along an arc of more than 90° such to obtain thereafter a finally remaining bend of 90°. This bending beyond 90° is disclosed in FIG. 6*b*, which Figure discloses further that thereby the already previously bent and oppositely located broad sidewall of the can body which at the beginning of the fourth bending step still stands upwards in a perpendicular state, which is illustrated in FIG. 6*b* by broken lines impedes this bending procedure beyond 90° and must, therefore, be temporarily pressed out of the way. To this end only the bending tool 20 illustrated in FIG. 6*a* and 6*b* and operative to produce the fourth bend includes additionally a double arm lever 30 which is pivotable around an axis 31 extending parallel to the bending edge 22 whereby the pivot plane is located in front of the shaping member 21. One lever arm 32 of the double arm lever 30 is pivoted upwards by the supporting body 23 for the roller 24 during the upwards movement of the supporting body 23 and due to this movement the other lever arm 33 of the double arm lever 30 which is offset towards the inside of the can body being produced is also pivoted and presses therefore the sidewall of the can body being produced temporarily outwards. The offset state of the double arm lever is illustrated in FIG. 6*c*. As already mentioned this double arm lever 30 is not provided in the other bending tools which have otherwise the same design and are operative to produce the previously made bends.

Figure 7:
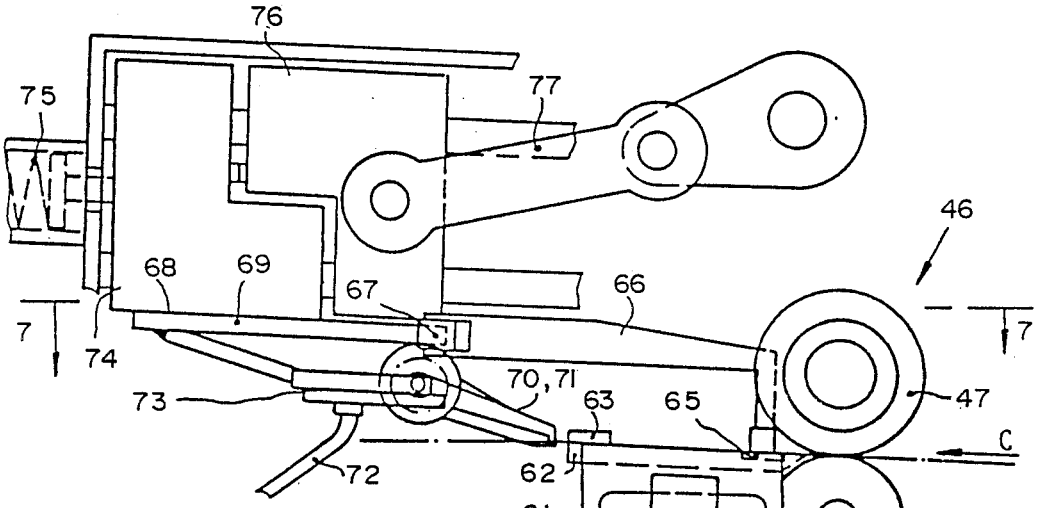
FIG. 7 a cut-out of the apparatus of FIG. 1 on an enlarged scale and including a front view of the members for conveying and welding of the can bodies.

According to the illustration of FIG. 4 the blank is held tightly on the intermediate table 4 during the producing of the bend by means of an arresting device 34 and cooperating spring 35. Below the intermediate table 4 is located a conveying apparatus formed by a ledge 40 which is reciprocatably movable in the advancing direction and includes pawls 41 mounted pivotably and at mutual difference thereon. The principle of conveying or feeding by pawls is generally known. The pawls 41 pivot completely into the ledge 40 when the ledge returns under a can body and are moved upwards by action of spring 42 to come into abutment at the rear edge of a can body formed from the blank. A part of this feeding ledge 40 with pawls 41 and springs 42 is illustrated in FIG. 7 and can be seen clearly in this Figure. The feeding ledge 40 shown in FIG. 7 partly broken away extends from the beginning of the deforming station 5 completely therethrough and beyond same as will be explained later in more detail. The bending tools 20 are arranged one after the other relative to the direction of feed of this feeding ledge, the blank 3 is fed by the feeding ledge 40 and pawl 41 in timed steps from one to the next bending station 20 and one bend is thereby produced by each bending tool 20, and specifically at all consecutive blanks 3 at the same instance in that the lifting rods 28 at all bending tools 20 are moved upwards by the movable table 7 of the press.

As illustrated in FIG. 1 a conveying path 45 for the can bodies formed from the blanks 3 follows the deforming station 5 which conveying path extends up to shortly ahead of the welding station 46 located at the end thereof, in which station the two welding electrode rollers 47 and 48 for the producing of the welding seam are located. The reciprocatably operated conveying apparatus 40, 41 including the ledge 40 with the pawls 41 extends through the entire deforming station 5 and along the conveying path 45 to which a crank drive 50 for the reciprocating movement of the ledge 40 illustrated in FIG. 1 is connected. The crank 51 moves a carriage 53 mounted thereto via a connecting member 52 which carriage 53 is guided on two guide columns 54 mounted side by side. Two vertical supports 55 located at the front and the rear end of the carriage 53 of which one is illustrated in FIG. 7 broken away support the reciprocatingly moved ledge 40. A ledge 56 located at the forward support 55 and extending forward relative to the direction of feed includes at its opposite side surfaces one respective control cams 57. A lever 59 supporting a roller 58 at one end thereof is pressed against each control cam which lever 59 is pivotable around an axis 60. A roller 61 is located at the upper end of the lever 59 by means of which the lver 59 presses from the side against a not yet welded can body 3. This occurs at both opposite sides of the can body 3 in order to press the two edges 10 and 11 of the can body formed from the blank 3 against the guide rail 62. The pressing against by the two levers 59 proceeds during the position of the conveying apparatus with the reciprocatably moved ledge 40 as shown in FIGS. 7 and 8, which moves forwards during the following movement step in feeding direction, wherewith the pivotable levers 59 are pivoted by the control cams 57 away from the can body and simultaneously a next following can body 3 is fed into the final conveying position ahead of the welding electrode rollers 47 and 48.

Figure 9:
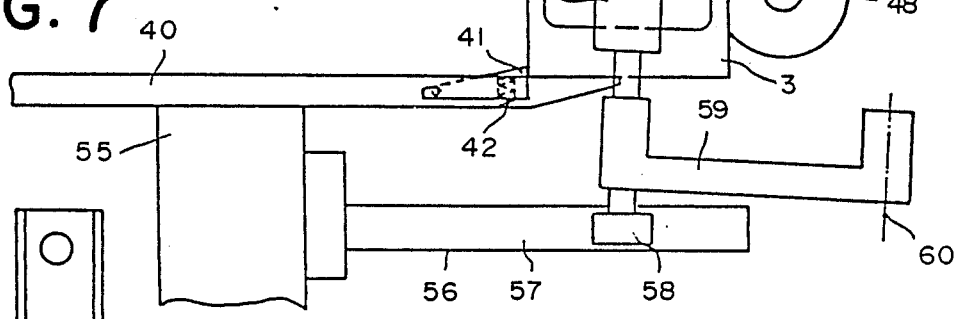
FIG. 9 is a side view in direction of the arrow C of FIG. 7 of the most important members below the line 7—7 of FIG. 7.
Figure 8:
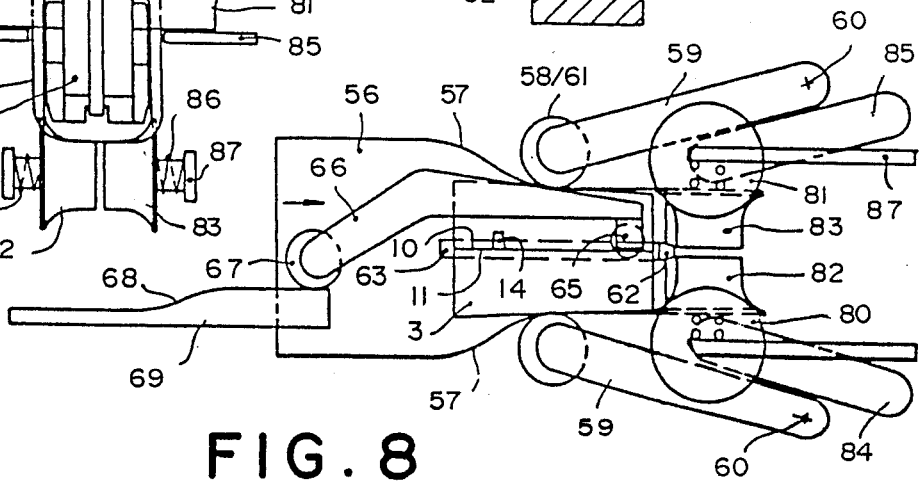
FIG. 8 is a top view of the most important parts of the members of the apparatus illustrated in FIG. 1, below the line 7—7 thereof.

The blank 3 of the embodiment illustrated in FIGS. 7 and 8 comprises at the edge 10 to be welded a projecting tear-open flap 14 at the end of the tear-open strip 13 and the can body tapers towards its one end. In this case the further feeding of the can body 3 located according to FIGS. 7 and 8 into the final feeding position ahead of the welding electrode rollers 47 and 48 occurs by independently driven further conveying means in form of a double tongue 70, 71 consistintg of two mutually parallel and simultaneously operated tongues 70 and 71, which double tongue 70, 71 grips the edges 10 and 11 to be welded on top at the rear edge and leads it further in the direction of feed between the welding electrode rollers 47 and 48, such as illustrated in FIG. 9 in which Figure the two tongues 70 and 71 located side by side can be seen clearly. In order to open and close the two tongues 70 and 71 are operated by pressurized air to which end the pressurized air flows a conduit 72 into an apparatus 73 for the generation of the operating stroke. The two tongues 70 and 71 are mounted on a tongue carriage 74 which is moved by a spring 75 in the direction of feed and is suitably guided for a reciprocating movement which is not illustrated in detail. The return movement of the tongue carriage 74 into the position illustrated in FIG. 7 proceeds by a separate, further carriage 76 which is coupled via a crank drive 77 to a separate drive. Accordingly, the first conveying means comprising the ledge 40 and pawls 41, and the second conveying means comprising the double tongue 70, 71 are driven independently from each other and are exactly tuned relative to each other for their timed stepwise operation.

Figure 10:
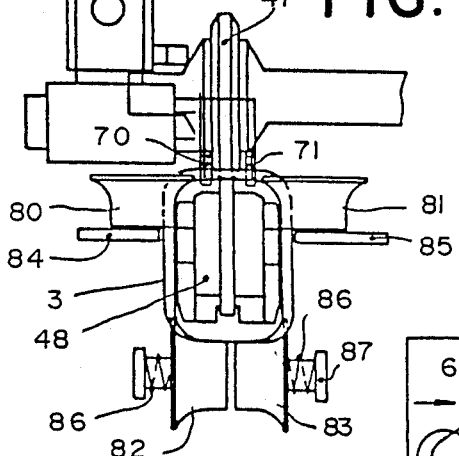
FIG. 10 illustrates the guide rail including an abutment stop, schematically and on an enlarged scale.
Figure 10:
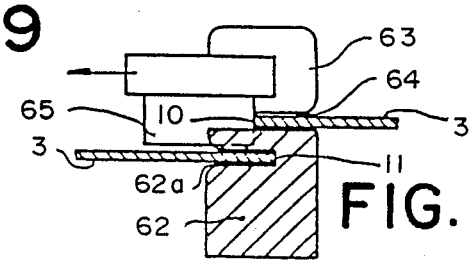

In order to weld the two edges 10 and 11 of the blank the Z-shaped guiding rail employed in the known resistance seam welding machines can not be used if a projecting tear-off flap 14 projects from the edge 10 of the blank. Therefore, the guide rail 62 used in this case and illustrated in FIG. 10 on an enlarged scale includes merely in a short guide rail section 63 at one end of the guide rail a groove 64 for receipt of the edge 10 of the blank 3, whereby the tear-open flap 14 projecting from this edge will come to lie ahead of the guide rail section 63. In order to have a further abutment for the edge of the blank for the exact positioning in the overlap position of the edges necessary for the welding together of the edges, an abutment body 65 is arranged in the zone of the other end of the guide rail 62 and located at the end of a pivotably supported double armed lever 66. A roller 67 is located at the other end of this lever 66 which rides on the control cam 68 of a ledge 69. This ledge 69 is mounted to the tongue carriage 74 and moves forward together with same such that after a certain length of the path the pivotable lever 65 is pivoted such that the abutment 65 is moved away from the edge 10 of the blank such that the tear-open flap 14 can pass this location. The abutment body 65 must also be pivoted out of the way to allow the double tongue 70, 71 which tightly holds the can body 3 during this feeding movement for an inserting of the can body inbetween the welding electrode rollers move past the abutment body 65. The guide rail 62 includes an uninterrupted groove 62a for the other edge 11 of the blank.

A calibrating apparatus in form of four rollers 80 to 83 which reset against the four rounded corners of the can body having a rectangular cross-section is located in the area of the two welding electrode rollers 47 and 48. If the can body as in the present case includes a cross-section which changes its size continuously along the longtiudinal extent of the can, i.e. tapers towards the one end, the can body is conveyed with its smaller cross-section at the leading end such that the calibrating rollers 80–83 must yield sideways because the crosssection of the can body is larger at the trailing end. Accordingly, the two rollers 80 and 81 are located at the end of pivotally supported levers 84 and 85, which are movable in a horizontal plane. The two rollers 82 and 83 are respectively acted upon by a pressure spring 86 which is supported against the roller and against a supporting device 87. The rollers 80–83 have a concave outer profile having a radius of curvature which corresponds to the radius of curvature of the rounded corners of the can body 3.

By means of the above described apparatus it is possible to produce can bodies with a rectangular cross-section and rounded corners at which at the same time the magnitude of the cross-section changes continuously along the length of the can body, i.e. when a taper is present. If such is not the case, one can for instance delete the abutment 65 at the guide rail 62 which can be swung out of the way and make use of a different guide rail which allows a guiding and conveying of the can body in such a way that the tear-open flap 14 is located thereby at the front zone of the can body realative to its direction of feed such that a groove can be provided behind this tear-open flap which is long enough for the edge. By means of small modifications of the above described apparatus it thus is possible to produce various kinds of can bodies by an electric resistance welding.

By means of an alternate embodiment of the welding apparatus it would be possible to produce a longitudinal seam also by a laser welding technique. Furthermore, the longitudinal seam may also be produced by a bonding process including a bonding agent.

While there are shown and described present preferred embodiments of the invention, it is to be distinctly understood that the invention is not limited thereto, but may be otherwise variously embodied and practiced within the scope of the following claims.

We claim:

1. A method of producing can bodies of a non-circular cross-section from planar blanks of which the oppositely located edges of the blank will be interconnected in a longitudinal seam, said blanks having an outer contour corresponding to the can bodies to be produced and being deformed in a deforming station by means of bending tools for respectively producing a plurality of can body sidewalls such that the edges to be interconnected are positioned opposite each other, comprising the steps of moving the blanks stepwise by means of a conveying apparatus through said deforming station in which at least one bend of the blank is produced by a respective one of a set of a plurality of bending tools being arranged one after the other in the direction of movement of the conveying apparatus and working simultaneously stepwise during each stop interval of the conveying apparatus such that a plurality of sidewalls is consecutively produced on the same blank, and then conveying the deformed blanks by said conveying apparatus to a working station located after the deforming station for interconnecting free longitudinal edges of each deformed blank by producing a longitudinal seam.

2. The method of claim 1, including the steps of individually removing blanks from a stack of superimposed blanks and forming in at least one area of a blank intended to form one sidewall of the can body, a flat impressment for stiffening the sidewall.

3. The method of claim 1, including the step of bending inwardly and upwardly by about 90 in said deforming station the areas of a planar blank adjacent the two edges of the blank which are to be interconnected, which areas each correspond to one half of a sidewall of the can body of the rectangular cross-section to be produced, said bending proceeding by means of a stationary held counter tool located at the inside and a moving pressing tool pressed thereagainst at the outside, and thereafter successively bending upwardly two further sidewalls from the areas of the blank restrained at the center of the blank and having a magnitude corresponding to such of the sidewall to be located opposite of said two edges, said bending being made by means of a stationary held counter tool located at the inside of the can body and of a moving pressing tool pressed thereagainst at the outside of the can body, each sidewall being bent out of the plane of the blank by more than 90 to spring back elastically to a 90 angle such that every sidewall is bent to a 90 bend allowing for the elasticity of the material and the circular deflection from the plane of the blank, and during the bending of the final sidewall, temporarily pressing back the opposite sidewall by one lever arm of a two-armed lever which is pivotable around an axis extending parallel to the bending edge, which lever arm is offset relative to the inner side of the two-armed lever and acts as pushing arm, the other lever arm being operated by said moving pressing tool.

4. The method of claim 1, wherein for producing of can bodies having a non-circular cross-section and a size which continuously changes along the longitudinal extent of the can body and includes a tear-open strip defined by pre-scored scoring grooves and a tear-off flap located at the end of said strip and projecting freely at an edge of said blank, conveying the already formed can bodies by first conveying means of said conveying apparatus stepwise timed into a position immediately ahead of the working station operative to produce the longitudinal seam, in which position the edges which are to be interconnected are brought by pivotable levers pressing against opposite sidewalls of the can body into an overlap position determined by a guide rail, and positioning the respective can body in such overlap position of its edges for grasping by an independently driven second conveying means of said conveying apparatus by grasping by means of clamping and pushing the can body into said working station to produce the longitudinal seam at a simultaneous pivoting away of said pivotable pressing levers, and simultaneously pivoting away laterally an abutment stop for the edge of the blank body which includes a tear-off flap of a tear-off strip to let said tear-off flap pass, which abutment stop is controlled by the drive of said second conveying means and cooperates with said guide rail.

5. The method of claim 1, including the step of interconnecting the edges of the blank which are located respectively opposite of each other after the deforming of the blank by longitudinal seam welding in a resistance roll-welding apparatus located after the deforming station.

6. An apparatus for producing can bodies of a non-circular cross-section, said apparatus comprising a deforming station including a plurality of bending tools, each tool operative successively for performing at least one step of a step-wise deforming of blanks conveyed in succession through said deforming station for the production of can bodies having a non-circular cross-section; conveying means operative for conveying the can bodies through said deforming station and along a conveying path, and a working station for producing a longitudinal seam, and adjoining the end of said conveying route and at the working station a calibrating apparatus for can bodies of a non-circular cross-section.

7. The apparatus of claim 6, in which every bending tool for the production of one respective bend at the can body of non-circular cross-section includes a shaping member kept stationary at the inner side of the can body as a counter tool and having a surface bent curvilinearly corresponding to the radius of the bend, and includes a pressing tool operative for pressing against the can body from the outside and having a roller and a bearing and supporting body thereof which pressing tool is longitudinally displaceable against the action of a spring on a guide which is pivotable around an axis extending parallel to the bending edge and perpendicularly to the guide, and in which said pressing tool is reciprocatably movable by means of a pivotably supported lifting rod along said curvilinear surface of said shaping member for deforming the can body blank between the shaping member and the pressing tool.

8. The apparatus of claim 7, in which all bending tools are located on a pressing table of a press which is in communication with an apparatus which includes a working station for producing the longitudinal seam, and in which lifting rods are pivotably mounted to a movable part of the press for a simultaneous operating of said pressing tools.

9. The apparatus of claim 8, in which in order to produce can bodies having a rectangular cross-section and rounded corners additional drawing tools are located at the pressing table operating to produce flat impressments in two areas of the planar blank intended to be shaped into oppositely located sidewalls in order to provide a stiffening of the sidewalls.

10. The apparatus of claim 7 for producing can bodies having a rectangular cross-section and rounded corners, in which said curvilinear surface of said shaping member extends over a circular arc of about 115, followed by a planar portion of said shaping member, in order to achieve a remaining bending of 90 by means of a bending step over more than 90 to thereby take into account the elasticity of the material.

11. The apparatus of claim 10, in which a double arm lever is arranged at said bending tool and is pivotable around an axis extending parallel to the bending edge and of which one lever arm is operable by the moveable supporting body of the pressing tool for pivoting thereof, and of which the other lever arm is offset towards an inner side of the can body to be produced and abuts as pressing arm an already bent sidewall of the can body in order to temporarily press this sidewall back during the bending of the opposite sidewall by more than 90.

12. The apparatus of claim 7, in which a double arm lever is arranged at said bending tool and is pivotable around an axis extending parallel to the bending edge and of which one lever arm is operable by the movable supporting body of the pressing tool for pivoting thereof, and of which the other lever arm is offset towards an inner side of the can body to be produced and abuts as a pressing arm an already bent sidewall of the can body in order to temporarily press this sidewall back during the bending of the opposite sidewall by more than 90.

13. The apparatus of claim 6, in which in order to produce can bodies of a non-circular cross-section and having a cross-sectional area which changes continuously along the length of the can body, said conveying means includes first conveying means including an oscillating ledge and pawls, independently driven second conveying means including a double tongue for grasping the can body at its rear end and at both sides of the edges to be interconnected at the final conveying position ahead of the working station for the production of the longitudinal seam and for inserting the can body thereinto, and further includes a tongue carriage that moves in the can body feeding direction by a spring means and that supports said double tongue, and a drive means for reconveying said tongue carriage.

14. The apparatus of claim 13, in which in order to produce can bodies of a non-circular cross-section, the cross-sectional area of which continuously changes along the length of the can, and which can bodies include a tear-open strip defined by pre-punched scoring lines and having at one end thereof a tear-open flap projecting freely at an edge of the blank, the apparatus includes ahead of the working station for producing the longitudinal seam a guiding rail with a continuous groove for receipt of one of the edges of the can body which are to be interconnected, and a short guide rail end section having a further groove for receipt of the other edge located above and having said projecting tear-open flap, and in which for the positioning of the edge located above in the overlapping state an abutment body is located adjacent to the other end of the guiding rod at lever pivotally mounted laterally of said guide rail for cooperation with the guiding rod and for pressing against said edge, which abutment body is pivotable laterally out of the way by means of said lever immediately prior to the passing of the tear-open flap projecting at the edge of the can body being conveyed.

15. The apparatus of claim 14, in which the controlled pivoting movement of said abutment body is coupled to the advancing movement of said double tongue, and in which said tongue carriage supporting said double tongue reciprocates and is provided with a ledge including a control cam abutted by one lever arm of said pivotally supported lever which includes at its other lever arm said abutment body.

16. The apparatus of claim 14, in which two pivotally supported levers are located at both sides of and at a distance from said guide rail and are operative to press against opposite can body outer surfaces, which levers are operative to press against the two edges of the can body to be interconnected, which can body due to the projecting tear-open flap is conveyed in a somewhat spread open state into said guide rail and an overlapped position of the edges.

17. The apparatus of claim 16, in which the pivoting movement of the levers which are operative to press against the can body outer surfaces is coupled to the advancing movement of the conveying apparatus which includes the reciprocatingly moved ledge having the pawls, and is controlled by control cams located at said conveying apparatus.

18. The apparatus of claim 6, in which in order to produce can bodies having a rectangular cross-section and rounded corners said calibration apparatus includes rollers located at the four corners of the can body and having a concave outer profile of which the radius of curvature corresponds to the rounded corners, and in which for the production of can bodies having a cross-sectional area which continuously changes along the length of the can body, said calibrating rollers are movably supported, and are carried by springs in order to yield as the magnitude of the cross-sectional area increases from one end of the can body towards the other end.

19. The apparatus of claim 6, in which said working station for producing the longitudinal seam at the can body is a resistance roll-welding maching having welding electrode rollers for performing electric resistance welding.

* * * * *